US007362057B2

(12) United States Patent
Lin

(10) Patent No.: US 7,362,057 B2
(45) Date of Patent: Apr. 22, 2008

(54) MULTI-WAY FLASHING CONTROL BOX FOR LAMP STRINGS

(76) Inventor: Vincent Lin, No. 39, Sec. 3, Chung-Hua Rd., Hsin-Chu City (TW)

( * ) Notice: Subject to any disclaimer, the term of this patent is extended or adjusted under 35 U.S.C. 154(b) by 99 days.

(21) Appl. No.: 11/492,034

(22) Filed: Jul. 25, 2006

(65) Prior Publication Data

US 2007/0279920 A1 Dec. 6, 2007

(30) Foreign Application Priority Data

Jun. 2, 2006 (CN) ..... 2006 2 0115724 U

(51) Int. Cl.
*H05B 37/00* (2006.01)

(52) U.S. Cl. ..... 315/185 S; 315/185 R; 315/360; 315/312; 362/654; 362/545; 362/549; 362/646

(58) Field of Classification Search ..... 315/185 S, 315/185 R, 169.3, 200 A, 360, 312, 323; 362/362, 545, 549, 646, 653, 654, 800, 806
See application file for complete search history.

(56) References Cited

U.S. PATENT DOCUMENTS 5,128,595 A * 7/1992 Hara ..... 315/312
RE34,717 E * 9/1994 Sanders et al. ..... 315/186
5,550,319 A * 8/1996 Segan et al. ..... 84/103
5,957,564 A * 9/1999 Bruce et al. ..... 362/84
6,786,625 B2 * 9/2004 Wesson ..... 362/545
7,066,628 B2 * 6/2006 Allen ..... 362/267
7,214,952 B2 * 5/2007 Klipstein et al. ..... 250/504 H
2007/0217209 A1 * 9/2007 Wong ..... 362/418

* cited by examiner

*Primary Examiner*—Haissa Philogene
(74) *Attorney, Agent, or Firm*—Davidson Berquist Jackson & Gowdey LLP

(57) ABSTRACT

A circuit board of a multi-way flashing control box includes a control circuit to be connected electrically to a plurality of LED lamp strings and operable to activate and deactivate the LED lamp strings, and a plurality of connecting units, each of which is for connecting electrically the control circuit to a respective LED lamp string. Each of the connecting units includes a string terminal to be connected electrically to the respective LED lamp string, first and second conductive retainers connected electrically and respectively to the control circuit and the string terminal, and a circuit protection member having opposite ends clamped removably and respectively by the first and second conductive retainers such that the control circuit is connected electrically to the string terminal via the circuit protection member.

3 Claims, 5 Drawing Sheets

MULTI-WAY FLASHING CONTROL BOX FOR LAMP STRINGS

CROSS-REFERENCE TO RELATED APPLICATION

This application claims priority of Chinese application no. 200620115724.1, filed on Jun. 2, 2006.

BACKGROUND OF THE INVENTION

1. Field of the Invention

The invention relates to a multi-way flashing control box for light-emitting diode (LED) lamp strings, more particularly to a multi-way flashing control box having circuit protection members that are easy to replace.

2. Description of the Related Art

In a festival or an occasion requiring a cheerful atmosphere, such as Christmas time, a lamp string is wound on an object to be decorated, such as a Christmas tree, to provide illumination during the night. To enhance the illumination effect, a control box is provided to control sequential flashing of differently colored lamp strings.

At present, light-emitting diodes (LEDs) are widely used to replace tungsten filament light bulbs in lamp string applications. For a light-emitting diode, the operating voltage and rated current value thereof are related to the color of the light emitted thereby. For instance, light-emitting diodes that radiate red, yellow or orange light have an operating voltage range of 1.8 to 2.2 volts, whereas light-emitting diodes that radiate blue, green or white light have an operating voltage range of 3.1 to 3.3 volts. Therefore, lamp strings formed from different colors of light-emitting diodes have different operating voltage and rated current requirements.

As shown in FIGS. 1 and 2, each LED lamp string has a cord 11 fixed to a corresponding string contact 121 of an inner cap member 12 of a conventional multi-way flashing control box 2 by direct soldering (only the connection between one cord 11 and the corresponding string contact 121 is shown in FIG. 2). The string contacts 121 are also connected electrically to a circuit board 13 that is responsible for activating and deactivating the lamp strings. Since LED lamp strings can have different rated current values, the conventional multi-way flashing control box 2 includes circuit protection members (such as resistors) respectively connected in series to the lamp strings. The resistances of the circuit protection members are chosen according to the rated current values in order to protect the lamp strings from damage due to excessive electric currents. However, whenever the number of diodes or the color of a target lamp string is changed, the corresponding circuit protection member must be changed as well. There is thus a need in the art to provide a multi-way flashing control box that enables manufacturers to replace circuit protection members with relative ease so as to suit target lamp strings that are to be controlled by the multi-way flashing control box.

SUMMARY OF THE INVENTION

Therefore, the object of the present invention is to provide a multi-way flashing control box having circuit protection members that are used to protect a plurality of light-emitting diode (LED) lamp strings and that are easy to replace.

Accordingly, a multi-way flashing control box of the present invention is adapted for electrical connection to a plurality of light-emitting diode (LED) lamp strings. The multi-way flashing control box comprises a housing and a circuit board disposed in the housing. The circuit board includes a control circuit adapted to be connected electrically to the LED lamp strings and operable to activate and deactivate the LED lamp strings, a control switch connected electrically to the control circuit and operable to enable and disable operation of the control circuit for activating and deactivating the LED lamp strings, and a plurality of connecting units, each of which is adapted to connect electrically the control circuit to a respective one of the LED lamp strings.

Each of the connecting units includes a string terminal adapted to be connected electrically to the respective one of the LED lamp strings, a first conductive retainer connected electrically to the control circuit, a second conductive retainer connected electrically to the string terminal, and a circuit protection member having a first end clamped removably by the first conductive retainer and a second end clamped removably by the second conductive retainer such that the control circuit is connected electrically to the string terminal via the circuit protection member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
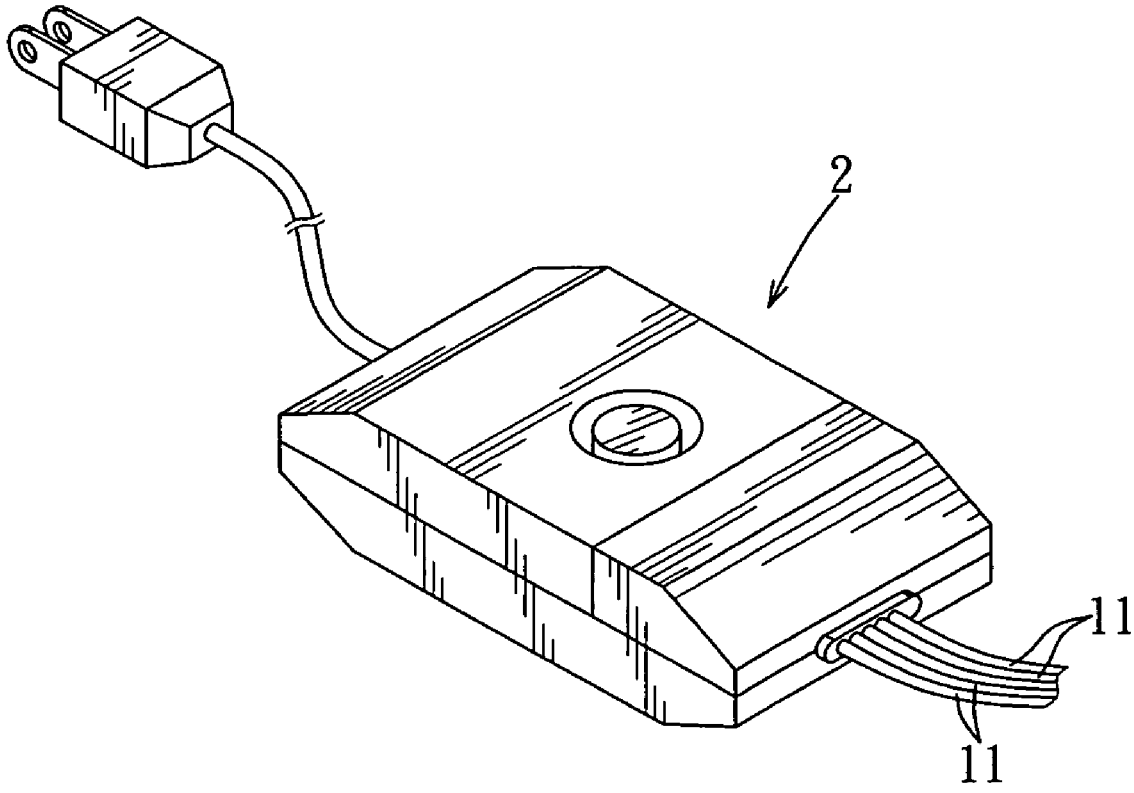
FIG. 1 PRIOR ART
FIG. 1 is an assembled perspective view of a conventional multi-way flashing control box.
Figure 2:
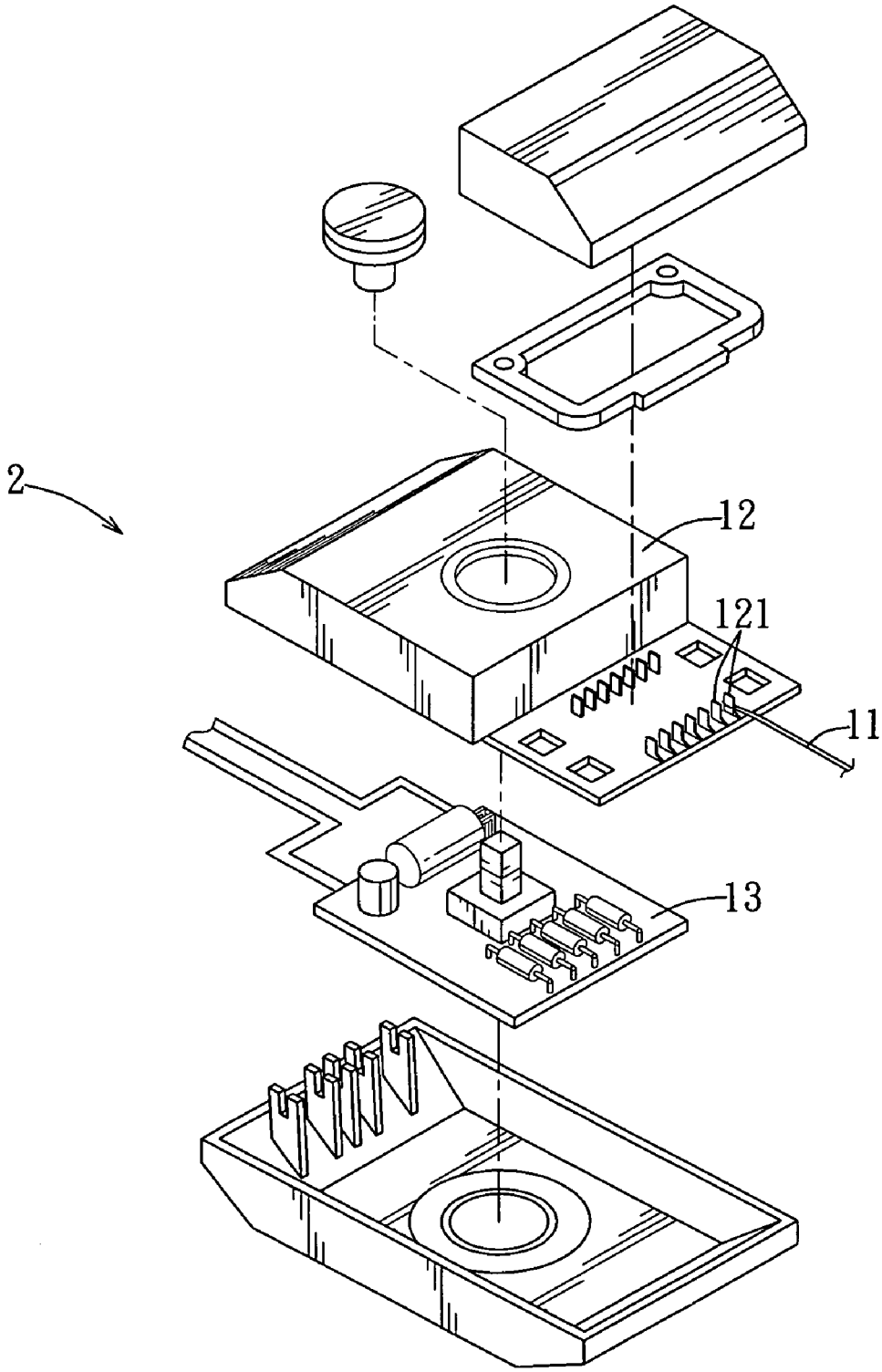
FIG. 2 PRIOR ART
FIG. 2 is an exploded perspective view of the conventional multi-way flashing control box.
Figure 3:
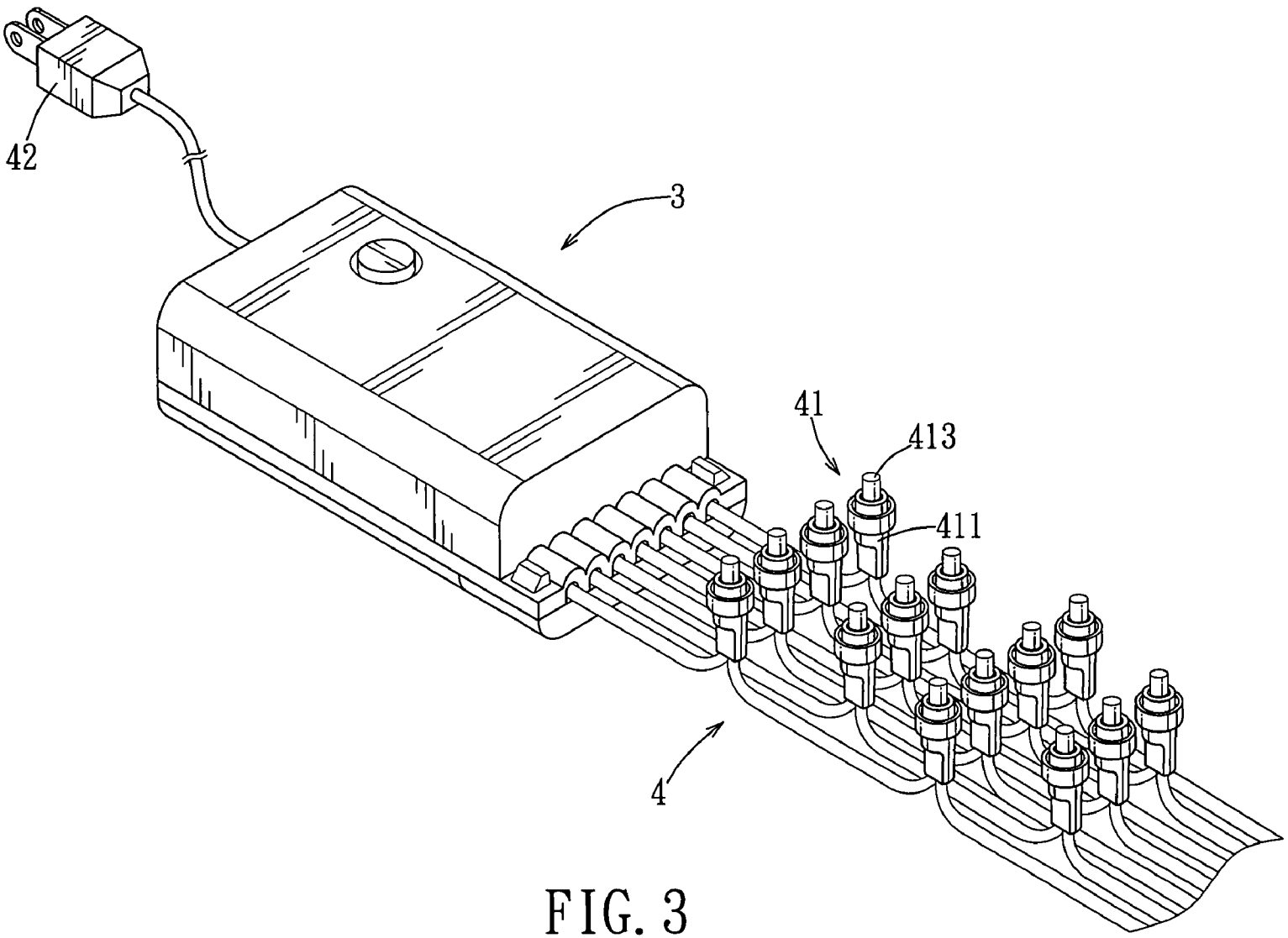
FIG. 3 is a perspective view of the preferred embodiment of a multi-way flashing control box for a set of LED lamp strings according to the present invention.
Figure 4:
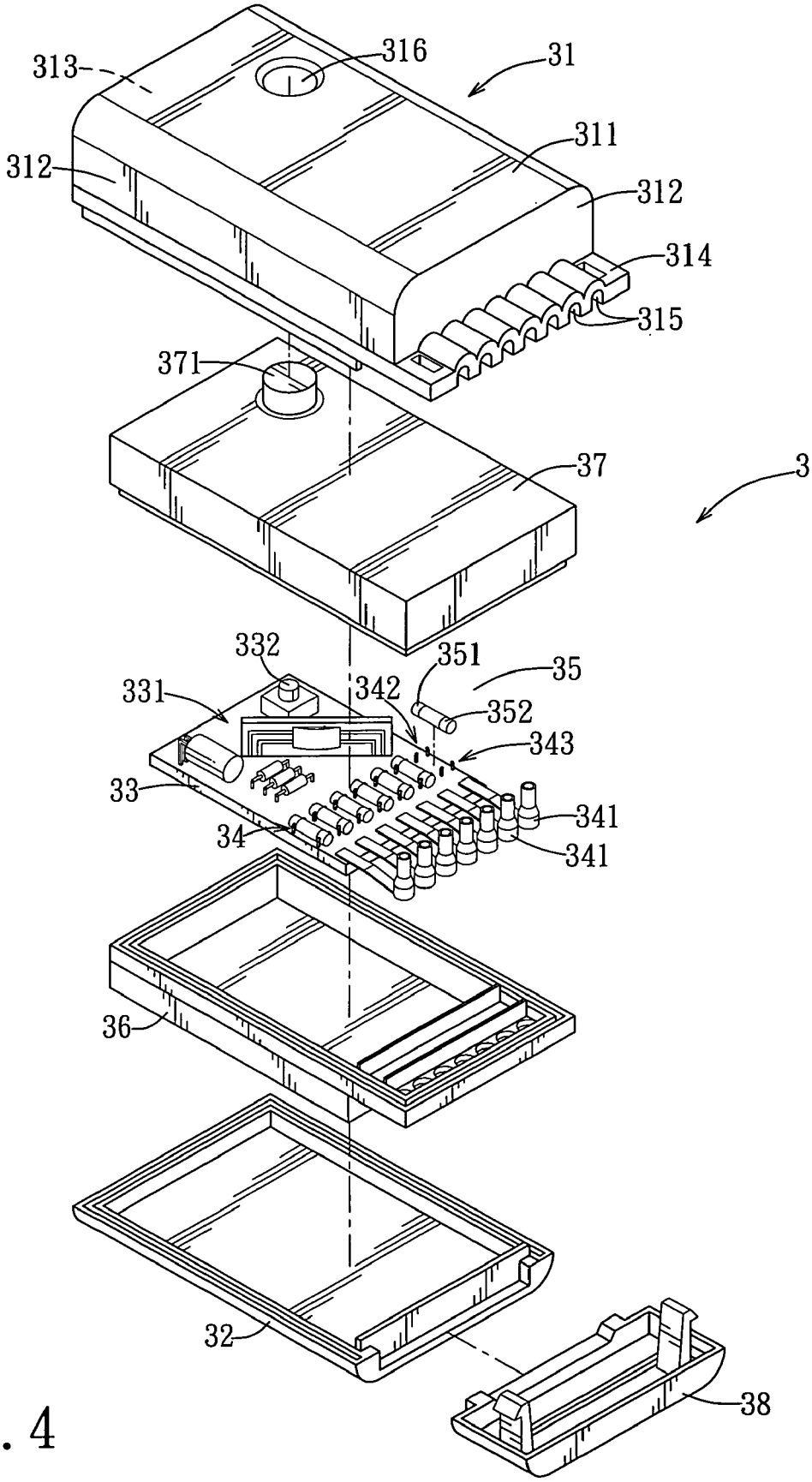
FIG. 4 is an exploded perspective view of the preferred embodiment.

Referring to FIGS. 3 and 4, the preferred embodiment of a multi-way flashing control box 3 according to the present invention is shown to be adapted for electrical connection to a plurality of light-emitting diode (LED) lamp strings 4, each of which includes a plurality of light-emitting diode units 41 that are connected electrically in series. Each of the light-emitting diode units 41 includes a lamp base 411 and a light-emitting diode 413 mounted to the lamp base 411. The control box 3 is further connected to a plug 42 that permits electrical connection to an external power source, and includes a housing 31, a cover plate 32, and a circuit board 33.

The housing 31 includes a central housing part 311 that is formed with a button hole 316, a plurality of lateral housing parts 312 that extend from a periphery of the central housing part 311 and that cooperate with the central housing part 311 to confine a chamber 313, and a connecting part 314 that extends outwardly and transversely from one of the lateral housing parts 312. The connecting part 314 is formed with a plurality of retaining grooves 315. The cover plate 32 is attached to one end of the lateral housing parts 312 of the housing 31 to close the chamber 313.

The circuit board 33 is disposed in the housing 31, and includes a control circuit 331 adapted to be connected electrically to the LED lamp strings 4 and operable to activate and deactivate the LED lamp strings 4 in a flashing manner, a control switch 332 connected electrically to the control circuit 331 and operable to enable and disable operation of the control circuit 331 for activating and deactivating the LED lamp strings 4, and a plurality of connecting units 34, each of which is adapted to connect electrically the control circuit 331 to a respective one of the LED lamp strings 4.

Figure 5:
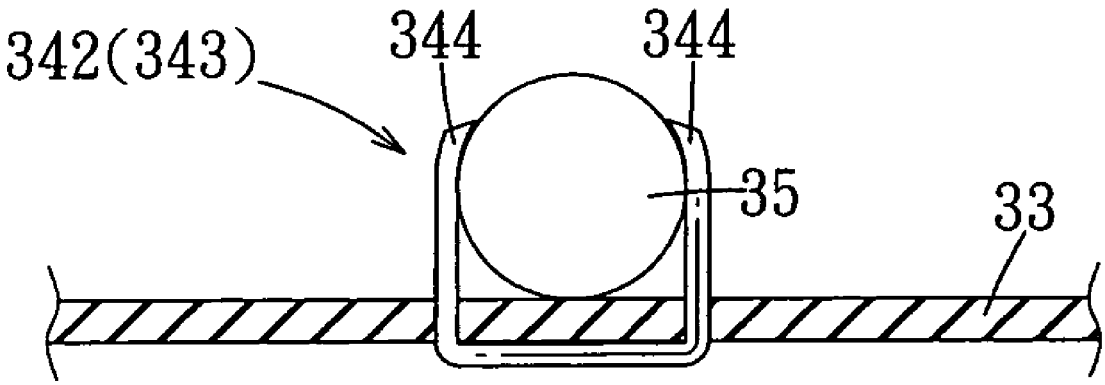
FIG. 5 is a fragmentary sectional view of the preferred embodiment to illustrate how a circuit protection member is clamped and retained by a pair of conductive spring arms of a conductive retainer.

Each of the connecting units 34 includes a string terminal 341 retained in a respective one of the retaining grooves 315 and adapted to be connected electrically to the respective one of the LED lamp strings 4, a first conductive retainer 342 connected electrically to the control circuit 331, a second conductive retainer 343 connected electrically to the string terminal 341, and a circuit protection member 35 having a first end 351 clamped removably by the first conductive retainer 342 and a second end 352 clamped removably by the second conductive retainer 343 such that the control circuit 331 is connected electrically to the string terminal 341 via the circuit protection member 35. In this embodiment, each of the circuit protection members 35 includes a resistor, and each of the first and second conductive retainers 342, 343 includes a pair of conductive spring arms 344, as best shown in FIG. 5. In view of the circuit protection members 35, the amount of electric current flowing through the LED lamp strings 4 can be controlled so as to protect the LED lamp strings 4 from damage. Moreover, in view of the clamping connection between each circuit protection member 35 and the corresponding pair of the first and second conductive retainers 342, 343, replacement of the circuit protection member 35 can be conducted with relative ease whenever the number of diodes or the color of the corresponding target LED lamp string 4 is changed.

Preferably, the control box 3 further includes an inner case 36 and an inner cover 37 disposed in the chamber 313 to enclose the circuit board 33 for waterproof protection. Furthermore, the inner cover 37 is provided with a press button 371 that is registered with the control switch 332, that extends out of the housing 31 via the button hole 316, and that is pressed to actuate the control switch 332. The control box 3 further includes a side cover plate 38 for engaging the connecting part 314 of the housing 31 to cover the retaining grooves 315.

While the present invention has been described in connection with what is considered the most practical and preferred embodiment, it is understood that this invention is not limited to the disclosed embodiment but is intended to cover various arrangement included within the spirit and scope of the broadest interpretation so as to encompass all such modifications and equivalent arrangements.

What is claimed is:

1. A multi-way flashing control box adapted for electrical connection to a plurality of light-emitting diode (LED) lamp strings, said multi-way flashing control box comprising a housing, and a circuit board disposed in said housing and including a control circuit adapted to be connected electrically to the LED lamp strings and operable to activate and deactivate the LED lamp strings, a control switch connected electrically to said control circuit and operable to enable and disable operation of said control circuit for activating and deactivating the LED lamp strings, and a plurality of connecting units, each of which is adapted to connect electrically said control circuit to a respective one of the LED lamp strings, wherein each of said connecting units includes a string terminal adapted to be connected electrically to the respective one of the LED lamp strings, a first conductive retainer connected electrically to said control circuit, a second conductive retainer connected electrically to said string terminal, and a circuit protection member having a first end clamped removably by said first conductive retainer and a second end clamped removably by said second conductive retainer such that said control circuit is connected electrically to said string terminal via said circuit protection member.

2. The multi-way flashing control box as claimed in claim 1, wherein said circuit protection member includes a resistor.

3. The multi-way flashing control box as claimed in claim 1, wherein each of said first and second conductive retainers includes a pair of conductive spring arms.

* * * * *